US005199134A

United States Patent [19]

Ripley

[11] Patent Number: 5,199,134

[45] Date of Patent: Apr. 6, 1993

[54] SYSTEM AND METHOD FOR PRODUCING A BLEACHED COTTON, NONWOVEN WEB

[76] Inventor: William G. Ripley, P.O. Box 3373, Lubbock, Tex. 79452

[21] Appl. No.: 612,558

[22] Filed: Nov. 13, 1990

[51] Int. Cl.[5] ..... D01G 21/00

[52] U.S. Cl. ..... 19/66 CC; 19/145.5

[58] Field of Search ..... 19/65 A, 65 R, 66 R, 19/66 CC, 80 R, 144, 145, 145.5, 145.7, 200, 201, 204, 205, 296, 297, 302, 304; 28/103, 104

[56] References Cited

U.S. PATENT DOCUMENTS

| | | | |
|---|---|---|---|
| 3,493,452 | 2/1970 | Cole | 19/296 |
| 3,802,030 | 4/1974 | Acree | 19/66 CC |
| 4,718,152 | 1/1988 | Suzuki et al. | 28/104 |
| 4,944,070 | 7/1990 | Girard et al. | 19/66 R |
| 5,038,438 | 8/1991 | Gunter | 19/65 A |

FOREIGN PATENT DOCUMENTS

| | | | |
|---|---|---|---|
| 8403309 | 8/1984 | PCT Int'l Appl. | 19/145.7 |

*Primary Examiner*—Peter Nerbun
*Assistant Examiner*—Michael A. Neas
*Attorney, Agent, or Firm*—Cort Flint

[57] ABSTRACT

A continuous textile processing system and method are disclosed for producing a nonwoven web containing bleached cotton fibers in a single line which includes a supply of fibers such as a bale opening device which opens bales of cotton fibers. A plurality of fiber delivery lines transport the fibers through a fiber opening process where the fibers are individualized and opened. The opened fibers are collected and fed to a blending system which includes plural blending units. The blended fibers are formed into a web and processed in a continuous flow bleaching unit. The fibers flow continuously through the bleaching unit as transported in the form of a web. The bleached fibers in the web are passed through a drier oven. The dried web of bleached cotton fibers is broken up by a fiber opening unit which separates the fibers from the web and opens the fibers for delivery to a carding system where the opened bleached fibers are carded into nonwoven webs and cross-lapped. The cross-lapped web including multiple webs of bleached cotton fibers is subjected to a hydroentanglement unit where water jets further interlock and entangle the fibers to make an integral web structure. The final nonwoven web consisting of bleached cotton fibers may be made into highly purified and absorbent wipes, pads, and other articles for medical, industrial, or domestic use.

27 Claims, 1 Drawing Sheet

SYSTEM AND METHOD FOR PRODUCING A BLEACHED COTTON, NONWOVEN WEB

BACKGROUND OF THE INVENTION

The invention relates to a system and method for producing nonwoven webs consisting of bleached cotton fibers.

Bleached cotton fibers have been used in many nonwoven fabric applications for cleanliness and absorbency such as wipes, pre-moistened towelettes, absorbent pads, etc.. The purified, absorbent fibers are particularly advantageous in hospital and medical applications such as disposable sheets, blankets, gowns, and bandages, and, particularly, because of their biodegradability. Typically the bleached cotton fibers are made into a nonwoven web and then fabricated for the particular end use.

The typical process has included many separated processing steps. Typically, raw cotton fibers are bleached at a remote bleachery using a large vat. The bleached fibers are dried and pressed into bales. The bales of bleached cotton fibers are then transported to a textile mill at another location where they are processed further by a nonwoven carding system into nonwoven webs in a conventional manner. Bleaching processes have not been a part of nonwoven textile processing lines. As a result, the textile process has been fairly inefficient incurring transportation costs, and inefficiency through piecemeal processing.

Various textile process lines for woven and nonwoven fabrics are known and have been proposed in the past. Various processes and systems are known for opening, cleaning, and blending fibers, for example, U.S. Pat. No. 2,718,671. Various processes and systems for opening fiber bales, and opening and cleaning the fiber before being carded into a web for woven or nonwoven applications are known, for example, as shown in U.S. Pat. No. 4,535,511.

It is known to make webs formed from synthetic fibers more integral by hydroentanglement techniques. Various hydroentanglement techniques and apparatus for producing integral webs having various patterns are shown in U.S. Pat. Nos. 3,494,821; 3,486,168; 3,485,706; 3,508,308; and 3,493,462.

The increased demand for the bleached cotton fiber, nonwoven products has rendered the prior bleaching and textile processes unsatisfactory.

Accordingly, an important object of the present invention is to provide a system and method for producing bleached cotton, nonwoven webs in a single processing line under one roof.

Another important object of the invention is to provide an efficient textile process system and method which begins with the opening of raw cotton fibers from bales and ends with the production of nonwoven webs consisting of bleached cotton fibers in a single process.

Another object of the invention is to provide a textile processing system and method wherein raw cotton fibers may be processed and bleached and the bleached fibers may be optionally baled or subjected to further processing and production of a nonwoven web.

SUMMARY OF THE INVENTION

The above objects are accomplished according to the present invention by a system and method for producing a nonwoven web which contains bleached cotton fibers in a single processing line using a continuous flow bleachery. The system includes bale opener for opening bales of cotton fibers. A first fiber opening unit individualizes and cleans the fibers to produce opened fibers. A fiber blending system mixes the opened fibers to produce blended fibers. A continuous flow, fiber bleaching system receives the blended fibers and produces bleached cotton fibers. A dryer dries the bleached fibers. A second fiber opening unit receives and stores the bleached fibers and opens the fibers to produce opened bleached fibers. A fiber storing and feeding system receives the opened bleached fibers. A carding machine receives the bleached fibers from the fiber storing and feeding system to produce a nonwoven carded web which contains the bleached cotton fibers. A web cross-lapping machine receives the nonwoven web and forms a cross-lapped web which has a plurality of web layers. A hydroentangling unit receives the cross-lapped web and entangles and interlocks the fibers in the web together to provide an integral web of bleached cotton fibers.

Preferably, a plurality of fiber feed lines receives fibers from plural bale opening devices. Each of the fiber feed lines includes a first fiber opening unit for individualizing and cleaning the fibers to produce opened fibers. A common conveyor collects the opened fibers from the plurality of fiber delivery lines and conveys the opened fibers to a common point so that the opened fibers may be fed to the fiber blending unit. The fiber blending system comprises a plurality of fiber blending units, and include a switch box for selectively delivering the opened fibers from the common point to either of the fiber blending units.

Optionally, a fiber baling press receives the opened bleached fibers from the second fiber opening unit and presses the fibers into bales of bleached cotton fibers. A switch box receives bleached opened fibers from the second fiber opening unit and selectively delivers the bleached opened fibers to one of the fiber baling press and the fiber storing and feeding system.

The fiber bleaching system is a continuous flow through system and includes a fiber card which receives and cards the blended fibers to produce a carded web which is bleached in the bleaching system. A dryer receives the bleached carded web from the fiber bleaching system and dries the bleached fiber in the web. The second fiber opening unit receives the bleached carded web and opens the fibers from the web into individual fibers.

The fiber storing and feeding system includes a reserve silo in which the bleached cotton fibers are stored. A vertical chute feed receives bleached cotton fibers from the reserve silos. A blower delivers bleached cotton fibers from the reserve silos to a vertical chute feed. The vertical chute feed feeds the bleached cotton fibers to the fiber carding machine.

In accordance with the invention, a textile process is disclosed for producing a nonwoven web of bleached cotton fibers comprising supplying raw cotton fibers which are opened for individualizing and cleaning to produce cleaned opened fibers. The opened fibers are blended, and a thin web is formed of the opened fibers. The thin web is subjected to a bleaching continuous flow process for producing a bleached web and fibers. The bleached web and fibers are dried. The fibers in the bleached web are subjected to an opening process in which the bleached fibers are separated from the web and opened for producing opened bleached fibers. The bleached fibers are opened and fed to a nonwoven carding machine for producing a carded web of bleached cotton fibers. The carded web is cross-lapped to produce a cross-lapped web having plural layers containing bleached cotton fibers. The cross-lapped web of bleached cotton fibers is subjected to a hydroentangling process for interlocking the fibers together in an integral web structure.

Optionally, the opened, bleached fibers are pressed together into fiber bales after bleaching and opening of the fibers. The delivery of the bleached open fibers are split between the baling and the carding process in a selective manner.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
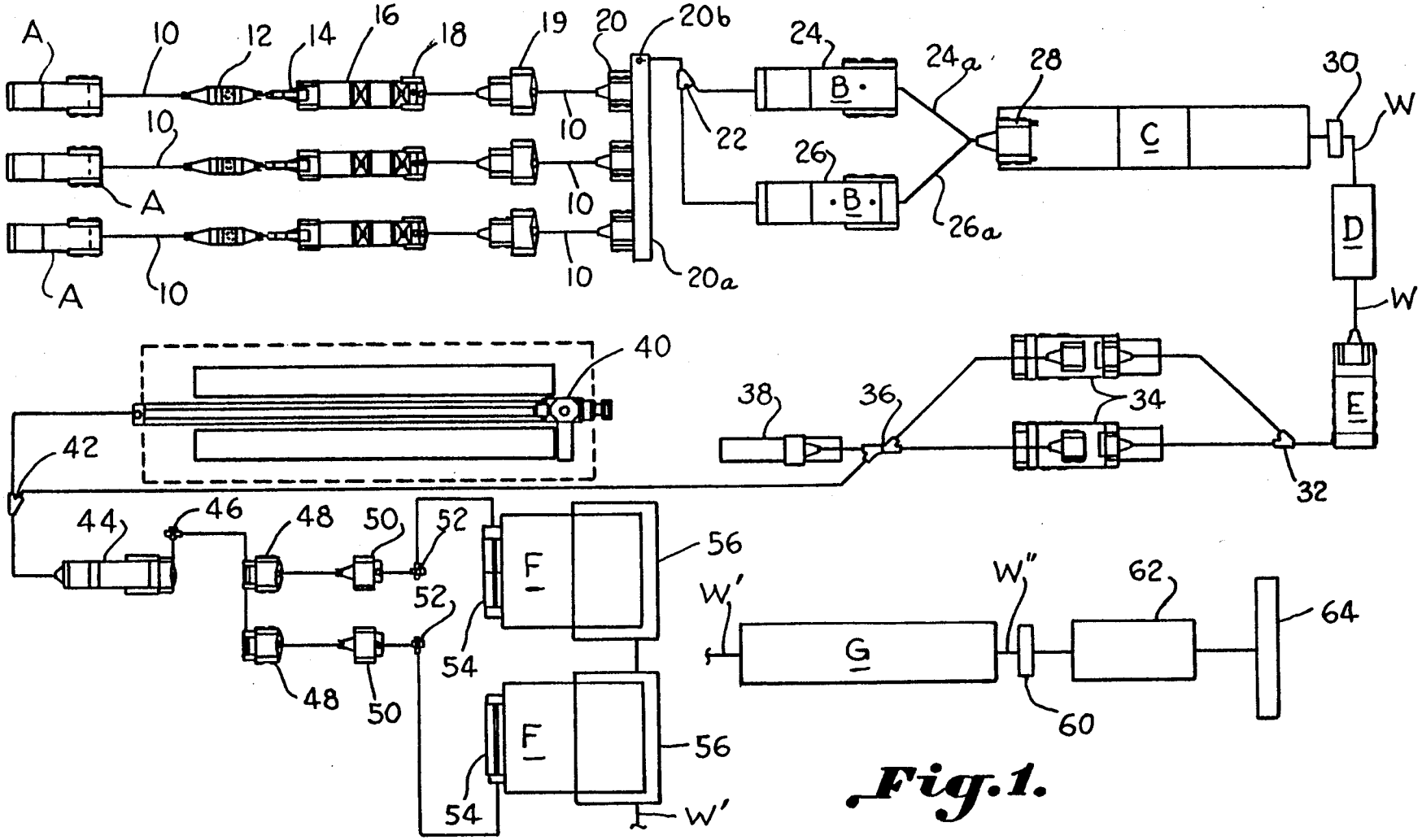
FIG. 1 is a schematic view illustrating a textile processing system and method for producing bleached cotton, nonwoven webs in a single processing line.

Referring now in more detail to the drawings, a system and method for producing a nonwoven web of bleached cotton fibers will be described which begins with three fiber delivery lines 10. Each line 10 includes a bale opener A which may be any suitable bale opener such as a HF6012 hopper feeder manufactured by Hollingsworth, Inc. of Greenville, S.C. Since fiber delivery lines 10 are identical, only one such line will be described for an understanding of the invention. Fibers from bale opener A are pneumatically transported to an air/fiber separator 12 which provides some initial fiber-/air separation and dust removal. The fiber goes into a condenser feeding unit 14, which cleans and removes dust from the fibers, and begins the process of opening and further individualizing the fiber. Any suitable condenser feeding unit may be used such as a KD condenser manufactured by Hollingsworth, Inc. Fiber is conveyed and drops down into a first fiber opening means in the form of a conventional incline cleaner 16 which has a series of rolls and grids (not shown) which clean the trash out of the fiber. The fiber passes through a micro dust suction unit 18 which is disposed on top of the incline cleaner to remove fiber from the incline cleaner through suction. Unit 18 acts as a doffer and removes micro dust in the transport air. Next, the fiber goes into a condenser cleaning unit 19 which typically includes a materials handling fan and a condenser to transport fiber out of incline cleaner unit 16. The fibers then are transported to a condenser feeding unit 20 where the fibers leave the three pneumatic fiber delivery lines, 10 and are deposited on to a common, mechanical conveyor 20*a* which blends the fibers.

At an end 20*b* of the conveyor, the fibers go to a switch box 22 which switches the fibers back and forth between second fiber blending means B which includes two cross blenders 24,26. Cross blenders 24, 26 may be any suitable fiber blenders such as LCB lay down cross blenders manufactured by Hollingsworth, Inc. The two cross blenders blend the fibers, providing some fiber opening, and act as a reserve to feed bleach feeding lines 24*a*, 26*a*. The fibers coming out of the bleach lines are conveyed to a bleaching unit C which bleaches the fibers. Plural blenders are used because the bleaching unit has a capacity of about 4000 pounds per hour, and each blender has a capacity of about 2500 pounds per hour. Change box 22 switches the fibers between lines 24*a*, 26*a*.

Bleaching unit C preferably includes a carding or other means 28 which forms a thin nonwoven cotton web from the fibers. The web traverses the bleaching unit via a plurality of rolls (not shown) for immersion in a bleaching agent. A suitable bleaching unit C is a continuous flow bleaching unit manufactured by Greenville Machinery of Greenville, S.C. The bleaching unit bleaches the fibers as they continuously flow through the bleaching unit as transported in the web form. A bleached fiber web W leaves bleaching unit C and may enter an optional foam dyer 30 which applies a flame or mildew retardant to the fibers while still wet. Fiber web W then passes into a dryer D which can be a conventional gas fired textile oven operating at a desired speed and temperature. The web dries and is delivered to a large fiber opening means E which separates the web into individual fibers, opening and individualizing the fibers in the process. When the web is bleached, it becomes compressed and wadded, so the fibers must be opened before further processing. Any suitable fiber opening means E may be utilized such as a 4 meter machine manufactured by Spinnbau GmbH of Germany. From bleaching unit C to opening means E, web W is conveyed in any suitable manner such as conventional rolls, etc.

From fiber opening means E, fiber is pneumatically conveyed to a second switch box 32, or 2 way distribution flap, to a pair of high capacity condensers 34 to handle the capacity of fibers. Condensers 34 may be any suitable condensers such as an MTO unit manufactured by Hollingsworth, Inc. Control valve 36 may deliver fibers to a fiber baler 38 if the fibers need to be stored and processed later, be used in another application, or if there is a need to bale fibers and sell bleached cotton fibers to a customer. In an alternate process line, previously baled, bleached cotton fibers may be opened and processed by an automatic bale opener such as an Optomix machine manufactured by Hollingsworth, Inc. The automatic bale opening system takes bleached cotton bales, such as baled at press 38, or other bleached cotton bales, at a rate up to 100 bales per side. The automatic bale opening machine processes the bleached fibers by opening the bales and removing the fibers. The removed fibers are pneumatically conveyed to a third switch box 42.

In the regular process line, press 38 is by-passed, and the fibers are pneumatically conveyed into a high capacity condenser 44 via switch box 42, and are conveyed by transport air from a blower 46. Next, the fiber is pneumatically conveyed to a fiber storing and feeding means which includes a pair of fiber tuft cleaners 48, and reserve hoppers or silos 50 for storage. Fibers from hoppers or silos 50 are pneumatically conveyed by fans 52 to vertical chute feeders 54 of a carding means F. Chute feeder 54 may be any suitable chute feeder such disclosed in U.S. Pat. No. 4,657,444, and carding means F may be a conventional nonwoven carding machine such as a Mastercard machine manufactured by Hollingsworth, Inc.

The carding machines produce a nonwoven web of carded bleached cotton fibers. The webs are cross lapped by conventional cross lapping machines 56. The bleached cross lapped cotton web W' is then fed to a hydroentanglement unit G which intermingles and interlocks the fibers together in an integral web W" of bleached cotton fibers so that it may be handled for further applications or fabrication of various end products. A suitable hydroentanglement unit is manufactured by Honeycomb Systems of Maine. As web W' enters the hydroentanglement unit, it encounters a series of very fine water jet units that pierce the carded web and causes the fibers to be intermingled and interlocked which holds the web together. Hydroentanglement is a rather unique process which provides softness and the drapeablility to the web, and a generally lint free web. The finished product would be lint free, and therefore, can be used in a lot of advantageous applications, like with instruments or electronics, and in hospitals. Finally, web W" may optionally be conveyed through a foam dyer 60 which dyes the web a solid color, and then to a dryer 62, after which the web may be taken up on a roller 64 for transportation and further product processing.

While a preferred embodiment of the invention has been described using specific terms, such description is for illustrative purposes only, and it is to be understood that changes and variations may be made without departing from the spirit or scope of the following claims.

What is claimed is:

1. A continuous fiber processing system for producing a bleached and blended cotton fibers comprising:

bale opening means for opening bales of cotton fibers;

a plurality of fiber feed lines receiving fibers from said bale opening means;

each of said fiber feed lines including a first fiber opening means for individualizing and cleaning said fibers to produce cleaned opened fibers; and first blender means comprising a common conveyor for collecting said opened and cleaned fibers from said plurality of fiber delivery lines and conveying said opened and cleaned fibers to a common point so that said opened fibers may be fed to second fiber blending means;

said second fiber blending means for further mixing said cleaned and opened fibers to produce cleaned and twice blended fibers;

web forming means receiving said cleaned and twice blended fibers;

continuous flow bleaching means for receiving said web of cleaned and blended fibers and producing a web of bleached cotton fibers;

a dryer for drying said web of bleached fibers;

second fiber opening means receiving said web of bleached fibers for opening said fibers and producing opened bleached fibers;

third blending means including a high capacity condenser means receiving opened bleached fibers from said second fiber opening means;

said high capacity condenser means includes a plurality of high capacity condensers; and a switch box receiving said opened bleached fibers from said second fiber opening means and blending said fibers by selectively distributing said fibers between said high capacity condensers;

a junction box connected to said plurality of high capacity condenser means;

a fiber baling means connected to said junction box for receiving and pressing said fibers into a bale of bleached cotton fibers; and said junction box being also connected to fiber cleaning, storing and feeding means so that fibers from said high capacity condenser means may be selectively fed to said fiber baling means for being pressed into bleached cotton fiber bales or to said fiber cleaning, storing and feeding means for delivery to fiber carding means.

2. The system of claim 1 including:

fiber cleaning, storing and feeding means for receiving said opened bleached fibers; and a plurality carding means for receiving said bleached fibers from said fiber cleaning and storing means for further blending said fibers and for producing a plurality of non-woven carded webs containing said bleached and cleaned cotton fibers.

3. The system of claim 2 including web cross-lapping means receiving said non-woven webs from said carding means and still further blending said fibers by forming at least a cross-lapped web having a plurality of web layers.

4. The system of claim 3 including hydroentangling means for receiving said cross-lapped web for further blending said fibers and entangling and interlocking said fibers in said web together to provide an integral web of bleached multiblended cotton fibers.

5. The system of claim 2 including hydroentangling means for receiving said web from said carding means for entangling and interlocking said fibers in said web together to provide an integral web of bleached cotton fibers.

6. The system of claim 1 wherein said second fiber blending means comprises a plurality of fiber blending units, and including a switch box for selectively delivering said opened fibers from said common point to either of said fiber blending units.

7. The system of claim 1 wherein said web forming means includes fiber carding apparatus for receiving and carding said blended fibers to produce a carded web which is bleached in said bleaching means.

8. The system of claim 1 wherein said dryer comprises a foam drying means for receiving and treating said bleached carded web from said fiber bleaching means and a web drying oven for receiving said bleached and treated carded web from said foam drying means; and said second fiber opening means receiving said treated and dried carded web from said drying oven for opening said fibers from said web into individual fibers.

9. The system of claim 1 wherein said fiber storing, cleaning and feeding means comprises:

a reserve silo in which said bleached and blended cotton fibers are stored;

a vertical chute feed receiving bleached and blended cotton fibers from said reserve silos;

blower means for delivering bleached and blended cotton fibers from said reserve silos to said vertical chute feed; and said vertical chute feed feeding said bleached and blended cotton fibers to said fiber carding means.

10. The system of claim 1 including means for applying an additive to said bleached cotton fibers while they are wet upon exiting said fiber bleaching means.

11. The system of claim 4 including a dryer for drying said hydroentangled web.

12. The system of claim 4 comprising dying means for dying said hydroentangled web a desired color.

13. A continuous textile processing system for producing a non-woven web of bleached cotton fibers comprising:

a supply of cotton fibers;

fiber opening means for individualizing and cleaning and blending said fibers to produce cleaned and opened fibers;

web forming means for producing a thin web from said cleaned and opened fibers;

continuous flow bleaching means for receiving said thin web of bleaching said fibers in a continuous flow and producing a bleached web;

a dryer for drying said bleached web of fibers;

second fiber opening means for opening and separating said fibers in said bleached web and producing individual opened bleached fibers;

condensing means operative to further open and twice blend said fibers;

fiber feeding means for feeding said opened, twice blended, and bleached fibers to multiple carding means;

said carding means carding said bleached, twice blended, and opened fibers producing a plurality of bleached non-woven webs and cross lapping means receiving and cross lapping said bleached non-woven webs, said cross lapping means thrice blending said fibers to produce a bleached non-woven multi-layered web.

14. The system of claim 13 including:

hydroentangling means for forming a hydroentangled web from said multi-layered non-woven web of thrice blended fibers in which said bleached cotton fibers are interlocked in an integral web structure.

15. The system of claim 13 wherein said fiber opening means includes:

a plurality of fiber feed lines receiving fibers from said bale opening means;

each of said fiber feed lines including a fiber separator, a micro dust section and a first fiber opening means for individualizing and cleaning said fibers and for producing opened fibers; and a common conveyor for collecting and blending said opened and cleaned fibers from said plurality of fiber delivery lines so that said fibers may be fed to said fiber blending means and further blended.

16. The system of claim 15 wherein said fiber blending means comprises a plurality of fiber blending units, and including a switch box for selectively delivering said blended opened fibers from a common point to either of said fiber blending units for further blending.

17. The system of claim 16 including hydroentangling means for forming a hydroentangled web from said non-woven web in which said bleached cotton fibers are interlocked in an integral web structure.

18. A continuous textile process for producing a non-woven web of bleached cotton fibers comprising:

supplying cotton fibers;

opening said fibers from said fiber supply;

feeding said fibers in a plurality of fiber delivery lines:

cleaning said fibers in said plurality of delivery line;

blending said fibers by collecting said fibers from said plurality of fiber delivery lines at a common point; and selectively switching said blended fibers at said common point between a plurality fiber blending units to further blend said fibers prior to their being supplied to said fiber bleaching process;

forming a thin web of said blended and opened fibers;

subjecting said thin web to a bleaching process for producing a bleached web and fibers;

drying said bleached web and fibers;

subjecting said fibers in said bleached web to an opening process in which said bleached fibers are separated from said web and opened for producing opened bleached fibers;

feeding said opened bleached fibers to condenser means for further blending of said bleached cotton fibers.

19. The process of claim 18 including; pressing said opened blended bleached fibers into fiber bales.

20. The process of claim 19 including; splitting the delivery of said bleached open fibers between a baling and a carding process in a selective manner;

said baling process forming bales of bleached fibers; and said carding process forming carded webs of said bleached carded fibers.

21. The process of claim 20 including; cross lapping said carded web to produce a cross-lapped web having plural layers which further blends and bleached cotton fibers.

22. The process of claim 21 comprising subjecting said cross-lapped web of bleached cotton fibers to a hydroentangling processes for interlocking said fibers together in an integral web structure.

23. The process of claim 22 including; drying said hydroentangled web.

24. The process of claim 18 including forming said thin web by carding.

25. The process of claim 18 including; feeding said blended fibers from said condenser means to a cleaning, storing and blending means where the fibers are further cleaned, further blended and stored.

26. The process of claim 25 including; delivering said stored yarn to a plurality of carding means where the fibers are formed into a plurality of carded webs;

cross lapping said carded webs so as to further blend said fibers;

delivering said cross lapped webs to a hydroentangling means to form a single web by further blending and entangling said fibers.

27. The process of claim 26 including; passing said hydroentangled web through a plurality of drying stations to dry said web and rolling said dried web into rolls.

* * * * *